US005193750A

United States Patent [19]

LaMontagne et al.

[11] Patent Number: 5,193,750

[45] Date of Patent: Mar. 16, 1993

[54] PERISTALTIC VOLTAGE BLOCK ROLLER ACTUATOR

[75] Inventors: Gregg S. LaMontagne, Austin; Daniel C. Soper, Manchaca, both of Tex.

[73] Assignee: Ransburg Corporation, Indianapolis, Ind.

[21] Appl. No.: 673,595

[22] Filed: Mar. 22, 1991

[51] Int. Cl.[5] ..... B05B 5/02

[52] U.S. Cl. ..... 239/708; 239/690; 417/477

[58] Field of Search ..... 417/477, 476; 239/690.1, 690, 691, 708, 704, 706

[56] References Cited

U.S. PATENT DOCUMENTS

| | | | |
|---|---|---|---|
| 1,665,262 | 1/1928 | Fortin . | |
| 2,414,355 | 1/1947 | Bogoslowsky . | |
| 2,547,440 | 4/1951 | Clark . | |
| 2,673,232 | 3/1954 | Silsby, Jr. . | |
| 3,098,890 | 7/1963 | Peterson . | |
| 3,122,320 | 2/1964 | Beck . | |
| 3,138,111 | 6/1964 | Kling . | |
| 3,140,666 | 7/1964 | Currie . | |
| 3,291,889 | 12/1966 | Uline . | |
| 3,463,092 | 8/1969 | Meyer | 417/477 |
| 3,492,409 | 1/1970 | Williams . | |
| 3,582,234 | 6/1971 | Israeli et al. . | |
| 3,644,068 | 2/1972 | Lepak . | |
| 3,732,042 | 5/1973 | Buchholz . | |
| 3,866,678 | 2/1975 | Jeter . | |
| 3,893,620 | 7/1975 | Rokadia . | |
| 3,899,010 | 8/1975 | Samson . | |
| 3,933,285 | 1/1976 | Wiggins . | |
| 3,934,055 | 1/1976 | Tamny . | |
| 4,017,029 | 4/1977 | Walberg . | |
| 4,020,866 | 5/1977 | Wiggins . | |
| 4,085,892 | 4/1978 | Dalton . | |
| 4,159,806 | 7/1979 | Scharfenberger . | |
| 4,217,062 | 8/1980 | Trp et al. . | |
| 4,228,930 | 10/1980 | Hogan . | |
| 4,231,668 | 11/1980 | Groth et al. . | |
| 4,275,834 | 6/1981 | Spanjersberg et al. . | |
| 4,313,475 | 2/1982 | Wiggins . | |
| 4,413,788 | 11/1983 | Schaefer . | |
| 4,424,011 | 1/1984 | O'Brien et al. . | |
| 4,518,327 | 5/1985 | Hackman | 417/477 |
| 4,522,571 | 6/1985 | Little . | |
| 4,530,647 | 7/1985 | Uno . | |
| 4,636,144 | 1/1987 | Abe et al. | 417/477 |
| 4,639,156 | 1/1987 | Stern et al. . | |
| 4,660,607 | 4/1987 | Griffith et al. . | |
| 4,660,771 | 4/1987 | Chabert et al. . | |
| 4,878,622 | 11/1989 | Jamison et al. . | |
| 4,976,590 | 12/1990 | Baldwin | 417/477 |
| 4,982,903 | 1/1991 | Jamison . | |
| 5,009,573 | 4/1991 | Ring, Sr. et al. | 417/477 |
| 5,024,586 | 6/1991 | Meiri | 417/477 |
| 5,033,942 | 7/1991 | Petersen | 417/477 |
| 5,064,358 | 11/1991 | Calari | 417/477 |

FOREIGN PATENT DOCUMENTS

| | | | |
|---|---|---|---|
| 891191 | 9/1953 | Fed. Rep. of Germany . | |
| 973454 | 2/1960 | Fed. Rep. of Germany . | |
| 2209300 | 6/1974 | France . | |
| 2458693 | 2/1981 | France . | |
| 764494 | 12/1956 | United Kingdom . | |
| 1023193 | 3/1966 | United Kingdom | 417/477 |
| 1393333 | 5/1975 | United Kingdom . | |
| 1478853 | 7/1977 | United Kingdom . | |
| 2009486 | 6/1979 | United Kingdom . | |

*Primary Examiner*—Andres Kashnikow
*Assistant Examiner*—Christopher G. Trainor
*Attorney, Agent, or Firm*—Barnes & Thornburg

[57] ABSTRACT

A peristaltic voltage block (34) couples a dispenser (10) to a source (20) of coating material. The peristaltic voltage block (34) has a length (220) of resilient conduit, a wall against which the resilient conduit lies in generally planar loops (222), and a rotor (246) including rollers (250, 350) for movably contacting the length (220) of resilient conduit at multiple contact points for substantially dividing the coating material in the peristaltic voltage block (34) into discrete slugs of coating material substantially to interrupt the electrical path through the coating material from the terminal to the coating material source (20). Either the wall or the rollers (250, 350) includes first regions where the loops (222) of resilient conduit lie, and second, raised regions. The second, raised regions adjacent the first regions retain the loops (222) of resilient conduit (220) in position.

5 Claims, 4 Drawing Sheets

PERISTALTIC VOLTAGE BLOCK ROLLER ACTUATOR

This invention relates to peristaltic voltage blocks primarily for use in electrostatically aided systems for atomizing and dispensing conductive coating materials.

Throughout this application, the term "voltage block" is used to describe both the prior art and the devices of the invention. It is to be understood, however, that these devices function to minimize, to the extent they can, the flow of current. Such current otherwise would flow from a dispensing device maintained at high electrostatic potential through the conductive coating material being dispensed thereby to the grounded source of such coating material, degrading the electrostatic potential on the dispensing device. Attempts to prevent this by isolating the coating material supply from ground result in a fairly highly charged coating material supply several thousand volts from ground. This in turn gives rise to the need for safety equipment, such as high voltage interlocks to keep personnel and grounded objects safe distances away from the ungrounded coating material supply.

Various types of voltage blocks are illustrated and described in U.S. Pat. No. 4,878,622, U.S.S.N. 07/357,851 and PCT/US89/02473, and in the references cited in those disclosures. Those disclosures are hereby incorporated herein by reference.

It is a primary object of the present invention to provide an improved peristaltic voltage block.

According to the invention, a coating material dispensing system comprises an electrostatic high potential supply having an output terminal on which the supply maintains a high electrostatic potential, and a source of coating material, a dispenser for dispensing the coating material. The output terminal is coupled to the dispenser to supply potential to the coating material dispensed by the dispenser. A peristaltic device couples the dispenser to the source of coating material. The peristaltic device has a length of resilient conduit and means for movably contacting the length of resilient conduit at multiple contact points for substantially dividing the coating material in the peristaltic device into discrete slugs of coating material substantially to interrupt the electrical path through the coating material from the terminal to the coating material supply. The means for movably contacting the length of resilient conduit comprises means for retaining the resilient conduit in position against the means for movably contacting the resilient conduit to prevent the resilient conduit from escaping contact with the means for movably contacting the resilient conduit.

Illustratively, the means for movably contacting the resilient conduit comprises a roller having an axle for rotatably mounting the roller, a first diameter in a first region where the roller contacts the resilient conduit, and a second and larger diameter in two regions adjacent the first region.

Further, illustratively, the peristaltic device further comprises a housing having a generally right circular cylindrical wall against which the resilient conduit lies in generally planar loops. The planes of the loops are generally perpendicular to the axis of the wall. The movable contacting means compresses the resilient conduit against the wall of the housing substantially to separate the coating material carried thereby into slugs.

Additionally, illustratively, each roller comprises a plurality of first regions, one for each loop. The axles of the rollers extend generally parallel to the axis of the wall. The first and second regions are provided by scallops on the surfaces of the rollers, and there are a plurality of such rollers.

Additionally, illustratively, the means for movably contacting the length of resilient conduit further comprises a rotor having an axle. Means are provided for rotatably mounting the axle of the rotor generally coaxially with the axis of the wall. The rotor defines a pocket corresponding to each roller. A cradle is selectively movable generally radially of the rotor axle in each pocket. Each cradle rotatably receives the axle of a roller. A cap retains each cradle in its respective pocket. The cap includes an opening through which the rollers projects to contact the resilient conduit but through which the cradle will not pass. A length of compliant material is positioned between adjacent surfaces of each cradle and its respective cap to urge the cradle yieldably away from its respective cap. Illustratively, the compliant material has a somewhat hourglass shape transverse to its longitudinal extent.

The compliant material or stop is significant in other respects. (1) It provides positional control of the rollers. With the complaint stop the rollers can be adjusted out with various air pressure settings. If the compliant stop were not there the rollers move out to their maximum position at a low pressure. (2) The compliant stop permits smoother operation of helper. Since there is an area (40° approx.) which the rollers lose contact with the tubing.

The compliant stop will provide a smoother transition for the roller from the point at which it loses contact with the tubing and at the point where it makes contact once again.

The invention may be best understood by referring to the following description and accompanying drawings which illustrate the invention. In the drawings.

Figure 1:
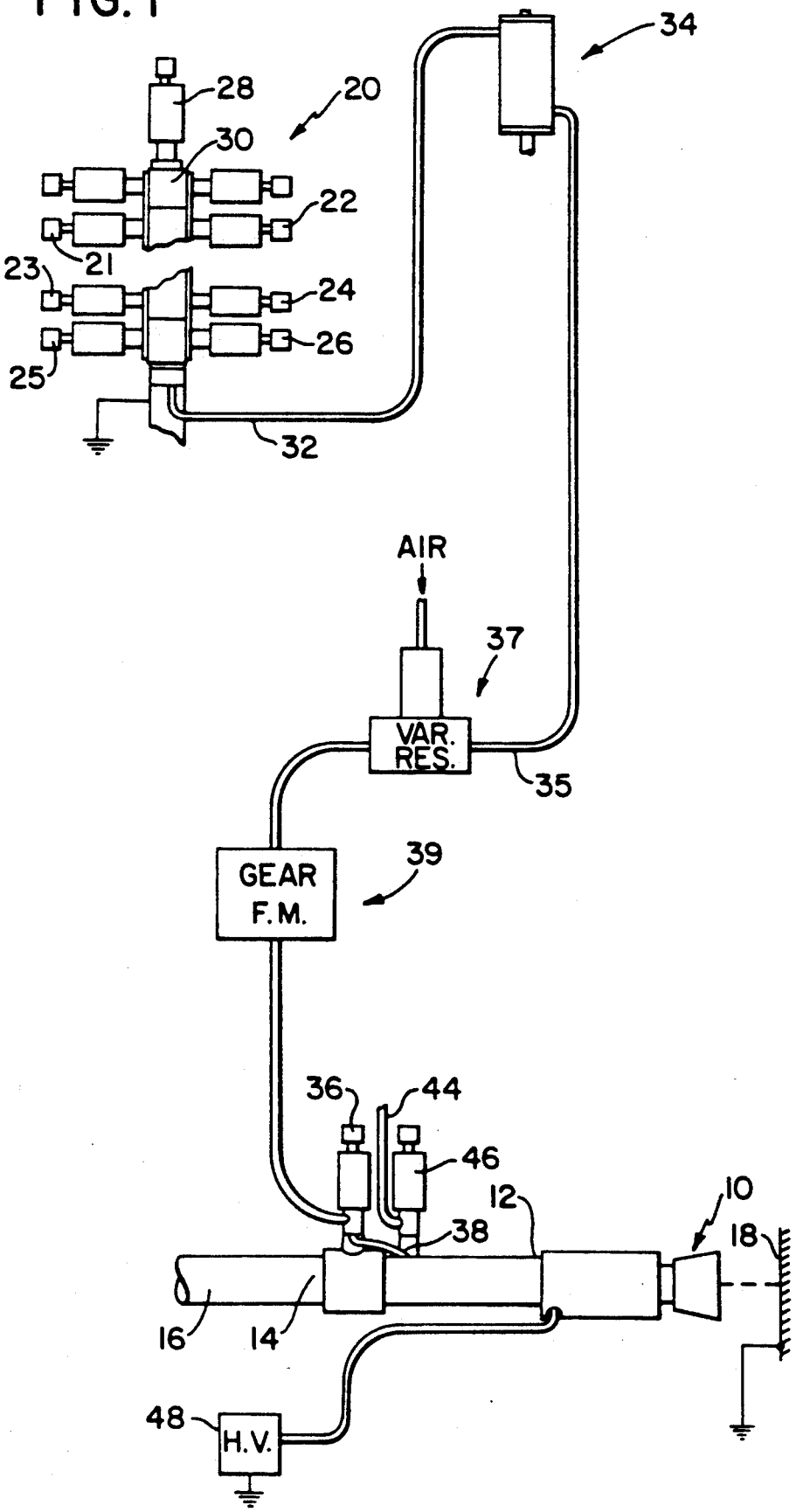
FIG. 1 illustrates a diagrammatic side elevational view of a system including a peristaltic voltage block according to the present invention.

In FIG. 1, a dispensing device 10 and some of the related electrical, liquid and pneumatic equipment for its operation are illustrated. Dispensing device 10 is mounted from one end 12 of a support 14, the other end 16 of which can be mounted to permit movement of dispensing device 10 as it dispenses coating material onto an article 18 to be coated, a "target," passing before it. Support 14 is constructed from an electrical insulator to isolate dispensing device 10 from ground potential.

The system further includes a color manifold 20, illustrated fragmentarily. Color manifold 20 includes a plurality of illustratively air operated color valves, six, 21-26 of which are shown. These color valves 21-26 control the introduction of various selected colors of coating material from individual supplies (not shown) into the color manifold 20. A solvent valve 28 is located at the head 30 of color manifold 20. A supply line 32, which is also maintained at ground potential, extends from the lowermost portion of color manifold 20 through a peristaltic voltage block 34, a length of compliant conduit 35 flowing through an air-controlled variable restrictor and 37, a gear flowmeter 39, to a triggering valve 36 mounted adjacent dispensing device 10. A feed tube 38 is attached to the output port of triggering valve 36. A coating material flowing through a selected one of color valves 21–26 flows through manifold 20 into supply line 32, through voltage block 34, compliant conduit 35, variable flow restrictor 37, flowmeter 39, triggering valve 36, feed tube 38 and into the interior of dispensing device 10. Operation of device 10 atomizes this selected color of coating material.

For purposes of cleaning certain portions of the interior of device 10 during the color change cycle which typically follows the application of coating material to each target 18 conveyed along a grounded conveyor (not shown) past device 10, a line extends from a pressurized source (not shown) of solvent through a tube 44 and a valve 46 to device 10. Tube 44 feeds solvent into device 10 to remove any remaining amounts of the last color therefrom before dispensing of the next color begins.

The coating material dispensed by device 10 moves toward a target 18 moving along the grounded conveyor due, in part, to electric forces on the dispensed particles of the coating material. To impart charge to the particles of coating material and permit advantage to be taken of these forces, an electrostatic high potential supply 48 is coupled to device 10. Supply 48 may be any of a number of known types. Although high potential supply 48 is illustrated as being coupled to device 10 by an electrical conductor, it is to be understood that high electrostatic potential can simply be supplied to the conductive coating material at the outlet end of peristaltic voltage block 34, with the electrostatic potential being supplied to device 10 through the conductive coating material.

Figure 2:
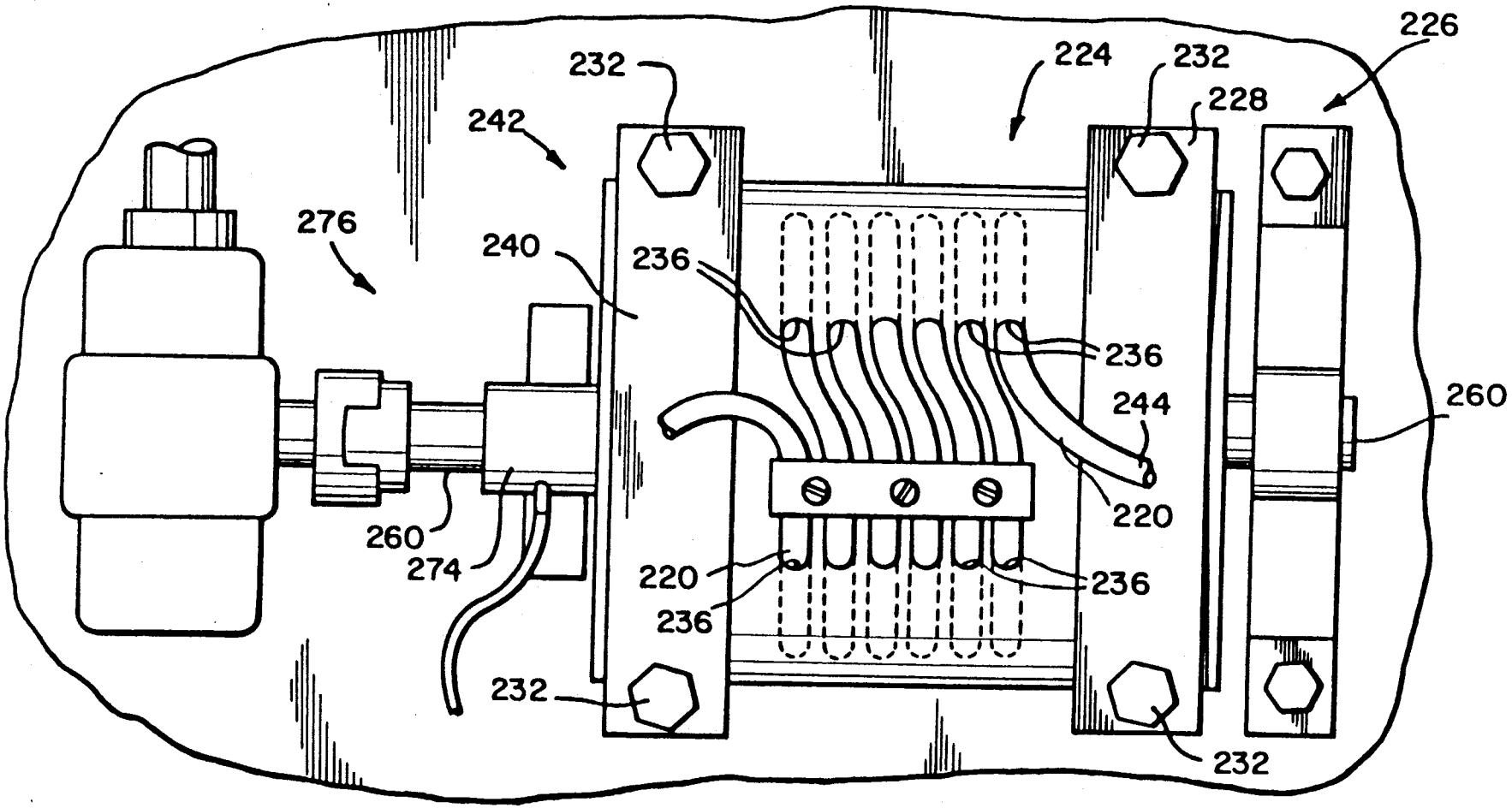
FIG. 2 illustrates a top plan view of a peristaltic voltage block constructed according to the present invention.
Figure 3:
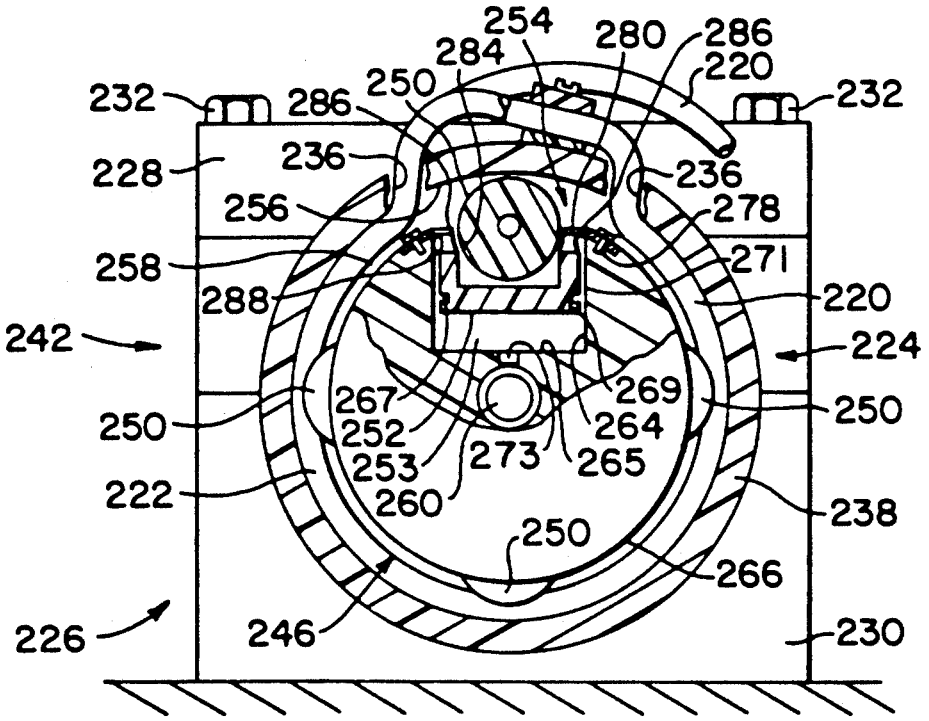
FIG. 3 illustrates a fragmentary sectional view, taken generally along section lines 3—3 of FIG. 2.
Figure 4:
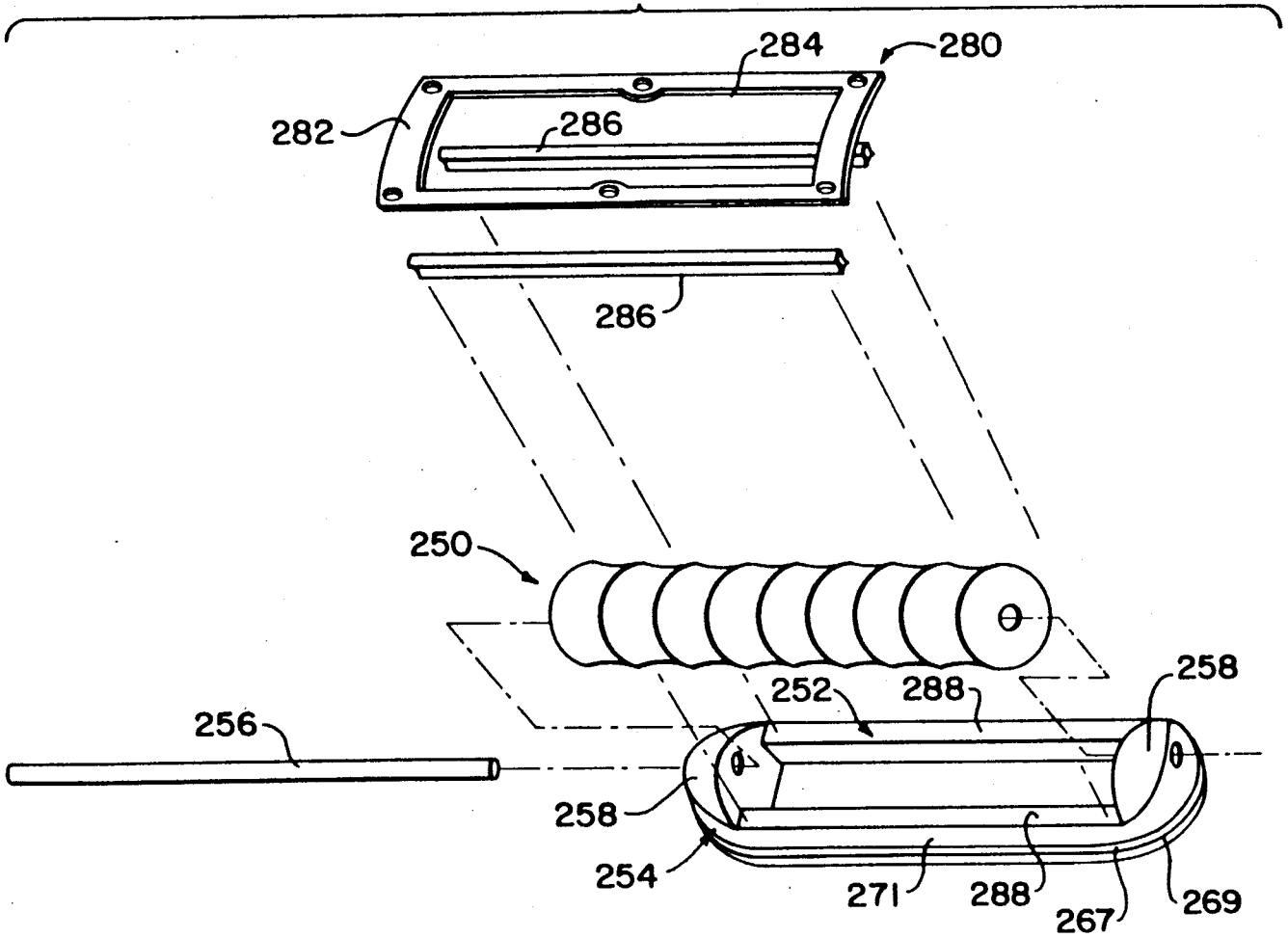
FIG. 4 illustrates a perspective view of a combination piston and cradle formed to support a contactor according to the embodiment of the invention illustrated in FIGS. 2-3.

In the embodiment of the peristaltic voltage block 34 illustrated in FIGS. 2–4, a resilient conduit 220 lies in planar loops 222 around the interior of a right circular cylindrical housing cartridge 224. Cartridge 224 is supported in a framework 226 including caps 228 mounted to a block 230 by cap bolts 232. The flat loops 222 are uniformly spaced axially along cartridge 224 and each loop 222 is substantially perpendicular to the axis of cartridge 224. The transfer of the largely separated slugs of coating material from one loop 222 to the next adjacent loop is achieved by threading the conduit 220 through passageways 236 provided in the sidewall 238 of cartridge 224. The transfer of coating material from each loop 222 to the next adjacent loop 222 as the coating material flows from the inlet end 240 of device 242 to the outlet end 244 thereof takes place outside of the cartridge 224 sidewall 238.

The rotor 246 construction illustrated in FIG. 3 is provided to speed solvent flushing of coating material from the device 242. The rollers 250 which actually contact the conduit 220 to separate the coating material in the conduit 220 into discrete slugs are rotatably mounted in elongated rectangular prism-shaped cradles 252. One long side 254 of each cradle 252 is open to receive its respective roller 250. The axles 256 of rollers 250 are rotatably mounted in the opposed short end walls 258 of cradles 252. The rotor 246 is provided with eight equally spaced longitudinally extending slots 264 (only one of which is illustrated) in its outer generally right circular cylindrical sidewall 266. Slots 264 are slightly larger in length and width than cradles 252. This permits the cradles 252 to be mounted in respective slots 264 for relatively free sliding movement radially of the axle 260 of rotor 246. Each slot 264 defines a pocket within which a respective cradle 252 is reciprocable radially of axle 260 of rotor 246. A chamber 253 is defined between the respective cradle 252 and the radially inner end, or head, 265 of its respective slot 264. An air bag 267 is provided in each slot 264. A port 273 is provided in the head 265 of each slot 264. Each port 273 communicates with a respective air bag 267. Compressed air is provided from a rotary air coupler 274 (FIG. 2) at the ground potential, or driven, end 276 of device 242. Each cradle 252 is held in the radially outer end 278 of its respective slot 264 by a cap 280 having an arcuately shaped outer surface 282 generally conforming to the contour of rotor 246. A plurality of, for example, electrically non-conductive plastic screws hold each cap 280 onto rotor 246 at the radially outer end of a respective slot 264. Each roller 250 protrudes through a longitudinally extending slot 284 in a respective cap 280. A strip 286 of compliant material having a somewhat hourglass-shaped section transverse to its longitudinal extent extends along each long edge of the outer end 288 of each cradle 252 between the outer end 288 of its respective cradle 252 and its respective cap 280. The compliant material of strip 286 illustratively is a thermosetting rubber, such as compound 215 or compound 253 available from Randolph Austin Company, Post Office Box 988, Manchaca, Tex. 78652. This material provides variable restraining force necessary to promote sufficient occlusion of the conduit 220, even when conduit 220 is somewhat worn, to block voltage.

The surface of each roller 250 is circumferentially scalloped at multiple locations along its length, one scallop for each loop 222. The scallops are shallow, being only five-one thousandths of an inch (0.005"–0.127 mm) and help to maintain the spacing of the loops 222 within cartridge 224 during operation of the voltage block 34.

Figure 5:
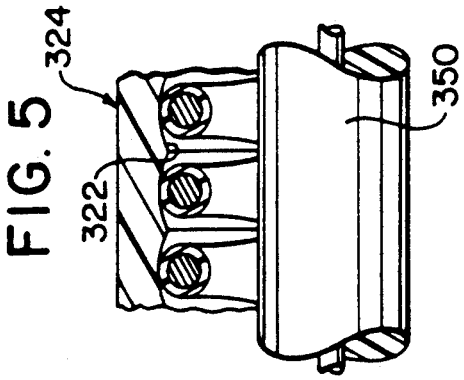
FIG. 5 illustrates a detail of an alternative embodiment of the system illustrated in FIG. 2.

Alternatively, and as best illustrated in FIG. 5, the interior 322 of the housing cartridge 324 can be scalloped (illustratively with the same 0.005"–0.127 mm depth) and the rollers 350 can be smooth.

The loop 222 nearest the inlet end of the cartridge 224 has an inside diameter up to twenty percent (20%) smaller than the inside diameters of the remaining loops 222. Illustratively, the inside diameter of the conduit in the first loop is ten percent (10%) smaller than the inside diameter of the conduit forming the remaining loops. This configuration results in a marked improvement in the voltage blocking capacity of the cartridge 224. It is believed that the conduit 220 between the rollers 250 of the voltage block 34 is typically expanded by fluid pressure, and that a small amount of fluid therefore tends to leak or "slip" past the points of contact of the rollers 250 with the conduit 220, reducing the voltage blocking capacity of the cartridge. The smaller inside diameter first loop causes a slight vacuum to be induced in the subsequent, larger inside diameter loops reducing the fluid slip at the points of contact of the rollers 250 with the larger inside diameter loops, thereby improving the voltage blocking capacity at each of these points of contact. The first loop 222 could also be constructed with an inside diameter gradient between its inlet, or ground potential, end and its end adjacent the second loop 222 by extruding the first loop on a mandrel having the desired diameter gradient.

In addition, the use of "lay-flat" conduit for the loops 222 of the peristaltic voltage block 34 has previously been discussed. It should be appreciated that the cross sectional areas of such conduit at all points along its length when it is empty will be essentially zero. Therefore, when such lay-flat conduit is employed, cross sectional area gradients between various locations along its length must be measured when it is full of coating material at those locations.

The cartridge 224 itself is constructed from acrylic material rather than the previously used nylon material. It is believed that, even with the same microfinish, acrylic material permits the conduit 220 in loops 222 to slip back and forth without as much elongation, adding to the life of the conduit 220. It is believed that this greater slip is permitted by the lower coefficient of friction of the acrylic material.

The conduit 220 which is loaded into the cartridge 224 is a coextruded conduit rather than the prior art single extrusion. The coextruded material has an approximately five mil thick inner wall of 87A Shore hardness, with the remaining wall material being 70A Shore hardness. The material used in the prior art single extrusion tubing was polyurethane. The material used in the coextruded tubing of the invention is Monsanto Santoprene TM thermoplastic elastomer or its equivalent.

When it is desired to employ the voltage blocking capacity of device 242, such as when an electrically highly conductive coating material is being supplied therethrough to a coating material atomizing and dispensing device maintained at high-magnitude electrostatic potential, compressed air is supplied through coupler 274 and ports 273 to air bags 267, forcing the rollers 250 outward and occluding conduit 220 between adjacent slugs of the conductive coating material. Rotor 246 divides the coating material substantially into electrically isolated slugs which move along conduit 220 peristaltically from inlet end 240 to outlet end 244 while maintaining a potential difference across ends 240, 244 substantially equal to the potential difference across the output terminals of the high-magnitude electrostatic potential supply. Compressed air is supplied to variable restrictor 37 (FIG. 1) to smooth out the pulsating effect of the passage of the slugs through compliant conduit 35.

When it is desired not to employ the voltage blocking capacity of device 242, such as when dispensing of an electrically conductive coating material is complete and the high-magnitude potential supply has been disconnected from the dispensing device in preparation for solvent flushing prior to a subsequent dispensing cycle with a different coating material, the compressed air source is disconnected from variable restrictor 37 and coupler 274 and the variable restrictor and coupler are vented to atmosphere. The resiliency of conduit 220 and the pressure of the solvent in conduit 220 are aided by strips 286 acting between caps 280 and cradles 252 to urge cradles 252 and their respective rollers 250 radially inwardly, permitting the free, rapid flow of solvent through conduit 220 to flush any remaining traces of the pre-change coating material from it. Compressed air can then be passed through conduit 220 to dry it in preparation for the next dispensing cycle.

What is claimed is:

1. A coating material dispensing system comprising an electrostatic high potential supply having an output terminal on which the supply maintains a high electrostatic potential, a source of coating material, a dispenser for dispensing the coating material, the output terminal being coupled to the dispenser to supply potential to the coating material dispensed by the dispenser, and a peristaltic device for coupling the dispenser to the source of coating material, the peristaltic device having a length of resilient conduit formed into generally planar loops, a plurality of rollers for movably contacting the length of resilient conduit at multiple contact points for substantially dividing the coating material in the peristaltic device into discrete slugs of coating material substantially to interrupt the electrical path through the coating material from the terminal to the coating material supply, each roller having an axle for rotatably mounting the rollers, a first diameter in axially spaced multiple first regions of the roller where the roller contacts the resilient conduit, one said first region for each loop, and a second and larger diameter in axially spaced multiple second regions of the roller adjacent respective said first regions, the planes of the loops being generally transverse to the axle, a housing having a generally right circular cylindrical wall against which the resilient conduit lies in said generally planar loops, the planes of said loop being generally perpendicular to the axis of the wall, the rollers compressing the resilient conduit against the wall of the housing substantially to separate the coating material carried thereby into said slugs, and a rotor having an axle, means for rotatably mounting said axle of said rotor generally coaxially with said axis of said wall, said rotor defining pockets whose locations correspond to the location of each said roller, and a cradle selectively movable generally radially of said rotor axle in each said pocket, each said cradle rotatably receiving the axle of a said roller, a cap for retaining each said cradle in its respective pocket, each said cap including an opening through which a respective said rollers projects to contact said resilient conduit but through which said cradle will not pass, and a length of compliant material positioned between adjacent surfaces of each said cradle and its respective said cap to urge said cradle yieldably away from its respective said cap.

2. A coating material dispensing system comprising an electrostatic high potential supply having an output terminal on which the supply maintains a high electrostatic potential, a source of coating material, a dispenser for dispensing the coating material, the output terminal being coupled to the dispenser to supply potential to the coating material dispensed by the dispenser, and a peristaltic device for coupling the dispenser to the source of coating material, the peristaltic device having a length of resilient conduit formed into generally planar loops, a plurality of rollers for movably contacting the length of resilient conduit at multiple contact points for substantially dividing the coating material in thee peristaltic device into discrete slugs of coating material substantially to interrupt the electrical path through the coating material from the terminal to the coating material supply, each rollers having an axle for rotatably mounting the roller, a housing against which the resilient conduit lies in said generally planar loops, the planes of said loops being generally perpendicular to the axis of the wall, the housing having a first diameter at axially spaced multiple first regions and a second and larger diameter at axially spaced multiple second regions adjacent respective said first regions, one said second region for each loop, the planes of said loops being generally perpendicular to the axis of said wall, said loops lying in said second regions, said rollers compressing the resilient conduit against said wall of the housing substantially to separate the coating material carried thereby into said slugs, and a rotor having an axle, means for rotatably mounting said axle of said rotor generally coaxially with said axis of said wall, said rotor defining pockets whose locations correspond to the location of each said roller, and a cradle selectively movable generally radially of said rotor axle in each said pocket, each said cradle rotatably receiving the axle of a said roller, a cap for retaining each said cradle in its respective pocket, each said cap including an opening through which a respective said roller projects to contact said resilient conduit but through which said cradle will not pass, and a length of compliant material positioned between adjacent surface of each said cradle and its respective said cap to urge said cradle yieldably away from its respective said cap.

3. The system of claim 2 wherein the axles of said rollers extend generally parallel to said axis of said wall.

4. The system of claim 3 wherein said first and second regions are provided by scallops.

5. The system of claim 1 or 2 wherein said compliant material has a somewhat hourglass shape transverse to its longitudinal extent.

* * * * *